US011148197B2

(12) United States Patent
Hideshima et al.

(10) Patent No.: US 11,148,197 B2
(45) Date of Patent: Oct. 19, 2021

(54) RAW MATERIAL FOR THIXOMOLDING, METHOD FOR PRODUCING RAW MATERIAL FOR THIXOMOLDING, AND MOLDED BODY

(71) Applicant: Seiko Epson Corporation, Tokyo (JP)

(72) Inventors: Yasutoshi Hideshima, Matsumoto (JP); Hidefumi Nakamura, Hachinohe (JP); Hiroyoshi Otaka, Hachinohe (JP)

(73) Assignee: Seiko Epson Corporation

( * ) Notice: Subject to any disclaimer, the term of this patent is extended or adjusted under 35 U.S.C. 154(b) by 78 days.

(21) Appl. No.: 16/117,324

(22) Filed: Aug. 30, 2018

(65) Prior Publication Data

US 2019/0060995 A1 Feb. 28, 2019

(30) Foreign Application Priority Data

Aug. 31, 2017 (JP) ..... JP2017-167945

(51) Int. Cl.
*B22F 1/02* (2006.01)
*B22F 9/08* (2006.01)
(Continued)

(52) U.S. Cl.
CPC ..... *B22F 1/02* (2013.01); *B22D 17/007* (2013.01); *B22D 17/2061* (2013.01);
(Continued)

(58) Field of Classification Search
None
See application file for complete search history.

(56) References Cited

U.S. PATENT DOCUMENTS 6,093,366 A * 7/2000 Kato ..... C04B 35/16 264/646
2001/0055539 A1 12/2001 Nakamura et al.
(Continued)

FOREIGN PATENT DOCUMENTS

JP 2000-212607 A 8/2000
JP 2001-158930 A 6/2001
(Continued)

OTHER PUBLICATIONS

Katsuyoshi Kondoh et al., "Microstructures and Mechanical Responses of Powder Metallurgy Noncombustive Magnesium Extruded Alloy by Rapid Solidification Process in Mass Production", Army Research Laboratory, Prepared by Joining and Welding Research Institute, Osaka University, May 2010, pp. 1-18.
(Continued)

*Primary Examiner* — Ronak C Patel
(74) *Attorney, Agent, or Firm* — Hamess, Dickey & Pierce, P.L.C.

(57) ABSTRACT

A raw material for thixomolding includes a magnesium-based alloy powder which contains calcium in an amount of 0.2 mass % or more and 5 mass % or less and aluminum in an amount of 2.5 mass % or more and 12 mass % or less, wherein the magnesium-based alloy powder includes an oxide layer which has an average thickness of 30 nm or more and 100 nm or less and contains at least one of calcium and aluminum as an outermost layer. The average dendrite secondary arm spacing of crystal structures of the magnesium-based alloy powder is preferably 5 μm or less.

11 Claims, 3 Drawing Sheets

(51) Int. Cl.

| | |
|---|---|
| ***B22F 1/00*** | (2006.01) |
| ***C22C 23/02*** | (2006.01) |
| ***B22D 17/00*** | (2006.01) |
| ***B22D 17/20*** | (2006.01) |
| *B22F 3/22* | (2006.01) |
| *C22C 1/04* | (2006.01) |
| *B21J 5/00* | (2006.01) |

(52) U.S. Cl.
CPC ..... *B22F 1/0011* (2013.01); *B22F 9/082* (2013.01); *C22C 23/02* (2013.01); *B21J 5/00* (2013.01); *B22F 3/225* (2013.01); *B22F 2009/0812* (2013.01); *B22F 2009/0828* (2013.01); *B22F 2301/058* (2013.01); *B22F 2304/15* (2013.01); *B22F 2999/00* (2013.01); *C22C 1/0408* (2013.01)

(56) References Cited

U.S. PATENT DOCUMENTS

| | | | | |
|---|---|---|---|---|
| 2004/0154703 | A1 | 8/2004 | Nakamura et al. | |
| 2014/0023547 | A1 | 1/2014 | Mitooka et al. | |
| 2014/0238191 | A1* | 8/2014 | Otsuka | C22C 23/02 75/235 |
| 2014/0238192 | A1* | 8/2014 | Otsuka | C22C 23/02 75/249 |
| 2016/0129162 | A1* | 5/2016 | Pulugurtha | A61L 31/022 623/1.46 |
| 2016/0194738 | A1* | 7/2016 | Manuel | C22C 23/00 428/336 |
| 2017/0281827 | A1* | 10/2017 | Baker | A61L 27/30 |

FOREIGN PATENT DOCUMENTS

| | | | |
|---|---|---|---|
| JP | 2001-162451 | A | 6/2001 |
| JP | 2001-303150 | A | 10/2001 |
| JP | 2011-125887 | A | 6/2011 |
| JP | 2013-007068 | A | 1/2013 |
| JP | 2014-162991 | A | 9/2014 |
| JP | 2014-167136 | A | 9/2014 |
| JP | 2017-061753 | A | 3/2017 |
| WO | WO-2012-137907 | A | 6/2012 |

OTHER PUBLICATIONS

Shigeru Akiyama et al., "Development of Noncombustible Magnesium Alloys", Kyushu National Industrial Research Institute, Materia Japan, vol. 39, No. 1, Oct. 26, 1999, with English translation (12 pages).

* cited by examiner

RAW MATERIAL FOR THIXOMOLDING, METHOD FOR PRODUCING RAW MATERIAL FOR THIXOMOLDING, AND MOLDED BODY

BACKGROUND

1. Technical Field

The present invention relates to a raw material for thixomolding, a method for producing a raw material for thixomolding, and a molded body.

2. Related Art

Magnesium is abundant in resources, and therefore is easily available. Further, the specific gravity of magnesium is about two-thirds of that of aluminum and about one-fourth of that of iron, and therefore, in the case where a variety of structures are produced using magnesium, it is possible to considerably reduce the weight of the structures. Moreover, magnesium also has properties such that an electromagnetic wave shielding property, vibration damping performance, machinability, and biosafety are all favorable. In view of these circumstances, components made of a magnesium alloy have begun to be used in the field of products such as automobiles, airplanes, cellular phones, and notebook personal computers.

As a method for producing components made of magnesium, casting methods such as gravity casting, die casting, and thixomolding, plastic working methods such as a hot extrusion method, a cold extrusion method, a rolling method, and a forging method, powder metallurgy methods such as a powder hot press method and a powder extrusion method, and the like are exemplified. Among these, thixomolding is a molding method in which a raw material generally in the form of pellets or chips is fed and heated in a cylinder by a heater, thereby being converted into a solid-liquid coexistent state where a liquid phase and a solid phase coexist, and also thixotropy is exhibited by dividing the solidification structure through screw rotation so as to further enhance the fluidity, thereby injecting the raw material into a die. By using such thixomolding, as compared with a die casting method in which a completely molten melt is injected into a die, molding of a thin-walled component or a component with a complicated shape can be performed.

For example, JP-A-2001-303150 discloses that metal particles made of a magnesium alloy which have a spherical shape with an average particle diameter of 1 to 5 mm, include 10 to 60 vol % primary crystal structures, and have an Mg—9% Al—0.7% Zn composition are applied to thixomolding. By using such metal particles, a semi-molten slurry which shows favorable fluidity at a sufficiently lower temperature than the liquidus temperature is obtained, the growth of primary crystal structures is suppressed, the primary crystal structures are finely and uniformly dispersed, and a product with few casting defects is obtained.

However, in the above-mentioned method, when metal particles in which the proportion of primary crystals is controlled are produced, a semi-solid slurry is discharged dropwise from a nozzle. Therefore, it has a problem that when the metal particles are produced, nozzle clogging is induced. Further, also in thixomolding using the metal particles, as the application to a product with a more complicated shape, improvement of the fluidity in a die has been demanded.

SUMMARY

An advantage of some aspects of the invention is to provide a raw material for thixomolding having favorable thixotropy, a method for producing the same, and a molded body having a high strength and few molding defects.

The advantage is achieved by the following configurations.

A raw material for thixomolding according to an aspect of the invention includes a magnesium-based alloy powder which contains calcium in an amount of 0.2 mass % or more and 5 mass % or less and aluminum in an amount of 2.5 mass % or more and 12 mass % or less, wherein the magnesium-based alloy powder includes an oxide layer which has an average thickness of 30 nm or more and 100 nm or less and contains at least one of calcium and aluminum as an outermost layer.

According to this configuration, a raw material for thixomolding having favorable thixotropy is obtained. Therefore, even if the shape is complicated, a molded body having a high strength and few molding defects can be injection molded.

In the raw material for thixomolding according to the aspect of the invention, it is preferred that the average dendrite secondary arm spacing of crystal structures of the magnesium-based alloy powder is preferably 5 μm or less.

According to this configuration, a molded body having particularly excellent mechanical properties is obtained.

In the raw material for thixomolding according to the aspect of the invention, it is preferred that the minimum particle diameter of the magnesium-based alloy powder is 0.5 mm or more.

According to this configuration, for example, when it is fed into an injection molding machine, the occurrence of bridging (clogging) or the like in a cylinder can be suppressed. Further, the specific surface area of the magnesium-based alloy powder is decreased, and therefore, the flame retardancy of the raw material for thixomolding can be particularly enhanced.

A method for producing a raw material for thixomolding according to an aspect of the invention is a method for producing the raw material for thixomolding according to the aspect of the invention, and includes producing the magnesium-based alloy powder by a spinning water atomization method.

According to this configuration, a raw material for thixomolding having favorable thixotropy can be produced.

A molded body according to an aspect of the invention includes the raw material for thixomolding according to the aspect of the invention.

According to this configuration, a molded body having a high strength and few molding defects is obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
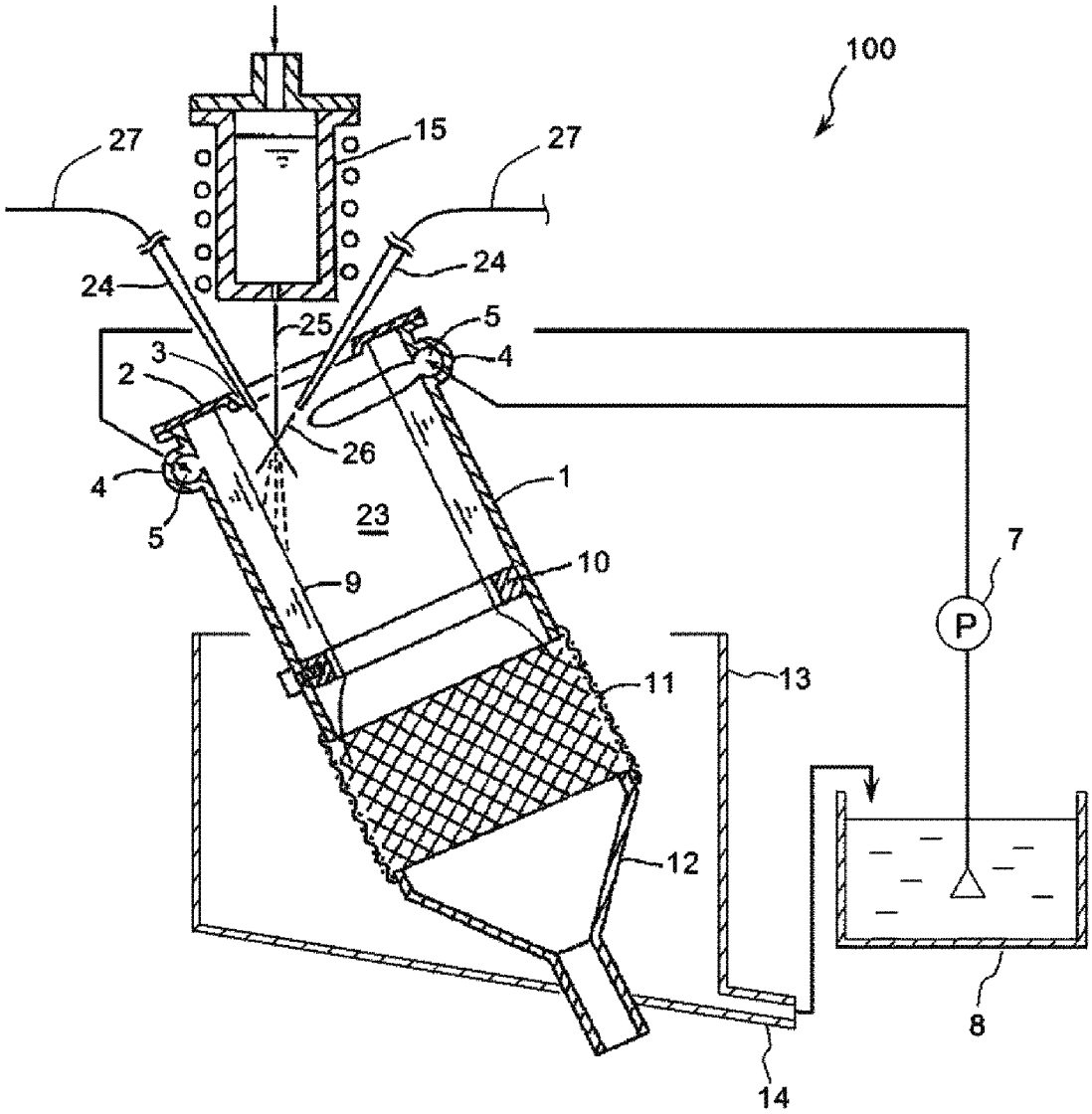
FIG. 1 is a longitudinal cross-sectional view showing an exemplary device for producing a magnesium-based alloy powder by a spinning water atomization method.

Hereinafter, a raw material for thixomolding, a method for producing a raw material for thixomolding, and a molded body according to the invention will be described in detail based on preferred embodiments illustrated in the accompanying drawings.

Raw Material for Thixomolding

A raw material for thixomolding according to this embodiment includes a magnesium-based alloy powder which contains calcium in an amount of 0.2 mass % or more and 5 mass % or less and aluminum in an amount of 2.5 mass % or more and 12 mass % or less. Further, the magnesium-based alloy powder includes an oxide layer which contains at least one of calcium and aluminum and has an average thickness of 30 nm or more and 100 nm or less as an outermost layer.

In such a raw material for thixomolding, adhesion of particles is suppressed by the oxide layer, and therefore, molding can be performed without causing bridging in a cylinder of an injection molding machine. Further, due to the presence of the oxide layer, a solidification structure with the oxide as a starting point is crystallized in a storage section in the cylinder, and thereby a solid phase in a solid-liquid coexistent state is uniformly micronized. As a result, the thixotropy in the storage section is improved, and thus, a solid-liquid coexistent slurry having favorable fluidity is formed. Accordingly, a molded body having few molding defects can be injection molded even if the shape is complicated.

Hereinafter, the above-mentioned magnesium-based alloy powder will be described in further detail.

The magnesium-based alloy powder is composed of a magnesium-based alloy. This magnesium-based alloy contains magnesium as a main component, and also contains calcium in an amount of 0.2 mass % or more and 5 mass % or less and aluminum in an amount of 2.5 mass % or more and 12 mass % or less. The magnesium-based alloy containing calcium and aluminum in such proportions has sufficient flame retardancy without largely decreasing the mechanical properties. Calcium and aluminum are mainly segregated at a crystal grain boundary, and in a portion where the crystal grain boundary appears on a powder surface, the thickness of the oxide layer is thicker than in a portion where the crystal grain boundary does not appear. The magnesium-based alloy powder according to this embodiment is a powder rapidly cooled by a spinning water atomization method or the like, and therefore, the crystal grain boundary tends to be micronized. Therefore, the length (area) of a crystal grain boundary appearing on a powder surface is also large, and as a result, the average thickness of the oxide layer tends to become thicker. Calcium and aluminum are not only segregated at a crystal grain boundary, but also may be present in any state. For example, calcium and aluminum can be present in a state of a simple substance, an oxide, an intermetallic compound, or the like. Calcium and aluminum may be uniformly dispersed (solid-dissolved) in the alloy.

When the contents of calcium and aluminum are less than the above lower limits, a sufficient oxide layer is not imparted to the magnesium-based alloy, and in the case where the alloy is used as the raw material for thixomolding, bridging is likely to occur, and therefore, there is a possibility that injection molding cannot be performed. On the other hand, when the contents of calcium and aluminum exceed the above upper limits, the ratio of calcium to magnesium is increased, and the thixotropy of the raw material for thixomolding or the mechanical properties of a molded body to be produced is/are deteriorated.

The content of calcium is set to preferably about 0.5 mass % or more and 4 mass % or less, more preferably about 0.8 mass % or more and 3.5 mass % or less.

The content of aluminum is set to preferably about 4.0 mass % or more and 7.0 mass % or less.

The main component refers to an element whose content (mass ratio) is the largest in the magnesium-based alloy. In this case, the content of the main component is preferably more than 50 mass %, more preferably 70 mass % or more, further more preferably 80 mass % or more.

The magnesium-based alloy may contain other components in addition to magnesium, calcium, and aluminum. As the other components, for example, lithium, beryllium, silicon, manganese, iron, nickel, copper, zinc, strontium, yttrium, zirconium, silver, tin, gold, a rare earth element (for example, cerium), etc. are exemplified, and among these, one type or two or more types may be added.

Among these, as the other components, particularly, at least one type selected from the group consisting of manganese, yttrium, strontium, and a rare earth element is preferably used.

As for the contents of the other components, the total content thereof is preferably about 0.01 mass % or more and 10 mass % or less, more preferably about 0.1 mass % or more and 5 mass % or less.

Magnesium is basically present in a state of a simple substance, but may be partially present in a state of an oxide, an intermetallic compound, or the like.

The average particle diameter of the magnesium-based alloy powder is preferably 0.5 mm or more and 5.0 mm or less, more preferably 1.5 mm or more and 3.0 mm or less. By setting the average particle diameter within the above range, the occurrence of bridging or the like in a cylinder of an injection molding machine can be suppressed. That is, by optimizing the size of the particle and the thickness of the oxide layer in each particle, the occurrence of bridging in the cylinder can be suppressed.

The average particle diameter of the magnesium-based alloy powder is the average of the diameters of circles having the same area as the area (the projected area of the particle) of a particle image taken using a light microscope, an electron microscope, or the like, and 100 or more particles selected randomly are used in the calculation of the average.

The minimum particle diameter of the magnesium-based alloy powder is not particularly limited, but is preferably 0.5 mm or more, more preferably 1 mm or more, furthermore preferably 2 mm or more. By setting the minimum particle diameter within the above range, for example, when it is fed into an injection molding machine, the occurrence of bridging (clogging) or the like in a cylinder can be suppressed. Further, the specific surface area of the magnesium-based alloy powder is decreased, and therefore, the flame retardancy of the raw material for thixomolding can be particularly enhanced.

The minimum particle diameter refers to the particle diameter of the second smallest particle among the particle diameters of 100 particles selected randomly.

Further, the minimum particle diameter of the magnesium-based alloy powder can be adjusted by a classification treatment using a mesh sieve or the like. For example, the minimum particle diameter can be adjusted to 0.5 mm or more by performing classification using a mesh sieve with an opening of 0.5 mm.

On the other hand, the maximum particle diameter of the magnesium-based alloy powder is not particularly limited, but is preferably less than 7 mm, more preferably 5 mm or less. According to this, the handleability of the raw material for thixomolding becomes favorable, and for example, a feeding operation into a cylinder can be efficiently performed.

The maximum particle diameter refers to the particle diameter of the second largest particle among the particle diameters of 100 particles selected randomly.

The average circularity of the magnesium-based alloy powder is preferably 0.5 or more and 1 or less, more preferably 0.6 or more and 1 or less. The magnesium-based alloy powder having such an average circularity can, for example, enhance the filling property in a cylinder when it is fed into an injection molding machine. As a result, the consolidation property during molding can also be enhanced, and a molded body having excellent mechanical properties is obtained. Further, the contact probability between particles is increased, and therefore, the heat transfer property is increased, and thus, the temperature uniformity during heating becomes favorable. As a result, a decrease in fluidity of a semi-molten slurry due to uneven temperature during heating can be suppressed. Accordingly, a molded body having high mechanical properties and high dimensional accuracy is obtained.

The average circularity of the magnesium-based alloy powder is the average of circularities calculated by the following formula: (the circumference of a circle having the same area as the projected area of a particle)/(the length of the outline of a particle image) in a particle image taken using a light microscope, an electron microscope, or the like, and 100 or more particles selected randomly are used in the calculation of the average.

The average aspect ratio of the magnesium-based alloy powder is preferably 0.5 or more and 1 or less, more preferably 0.6 or more and 1 or less. The magnesium-based alloy powder having such an average aspect ratio enhances the filling property in a cylinder likewise, and also achieves favorable temperature uniformity during heating. As a result, a molded body having high mechanical properties and high dimensional accuracy is obtained.

The average aspect ratio of the magnesium-based alloy powder is the average of aspect ratios calculated by the following formula: (the minor axis)/(the major axis) in a particle image taken using a light microscope, an electron microscope, or the like, and 100 or more particles selected randomly are used in the calculation of the average. The major axis is the allowable maximum length in a particle image, and the minor axis is the maximum length in a direction orthogonal to the major axis.

The apparent density of the magnesium-based alloy powder is preferably 0.2 g/cm$^3$ or more and 1.2 g/cm$^3$ or less, more preferably 0.3 g/cm$^3$ or more and 0.8 g/cm$^3$ or less. By setting the apparent density within the above range, the raw material for thixomolding having a particularly high consolidation property during molding is obtained.

The apparent density is also referred to as "bulk specific gravity" and can be determined as follows. When a powder in a given state is placed in a container of a given volume, the amount of the powder held in the container is measured, and the mass per unit volume is calculated. As the measurement method standard, for example, JIS Z 2504:2012 is used.

When the apparent density is less than the above lower limit, the filling property of the powder is deteriorated depending on the shape of the particle or the like, and the consolidation property during molding may be deteriorated. On the other hand, when the apparent density exceeds the above upper limit, while the filling property of the powder is increased, bridging or the like is likely to occur depending on the shape of the particle or the like, and the fluidity may be deteriorated. Therefore, the consolidation property during molding is deteriorated instead.

Whether or not the oxide layer is present on the surface of a particle (in other words, whether or not a particle has the oxide layer as the outermost layer) can be evaluated based on the gray levels in an observation image by an electron microscope or by analyzing the distribution state of calcium, aluminum, and oxygen. In the latter method, for example, when the concentration of calcium or the concentration of aluminum and the concentration of oxygen are both higher on the surface than inside the particle, it can be evaluated that the oxide layer containing at least one of calcium and aluminum is present on the surface of the particle. In the measurement of these concentrations, for example, spark discharge atomic emission spectrometric analysis (OES), X-ray photoelectron spectroscopy (XPS), secondary ion mass spectrometry (SIMS), electron beam micro-analysis (EPMA), Auger electron spectroscopy (AES), Rutherford backscattering analysis (RBS), or the like is used.

In the case where the oxide layer contains calcium, the concentration of calcium in the oxide layer is preferably 2 times or more, more preferably about 3 times or more and 1000 times or less, further more preferably about 5 times or more and 800 times or less the concentration of calcium inside the particle in mass ratio. When the difference in the concentration of calcium is within the above range, excellent flame retardancy and fluidity (moldability) and excellent mechanical properties after molding can be highly achieved simultaneously.

Similarly, in the case where the oxide layer contains aluminum, the concentration of aluminum in the oxide layer is preferably 2 times or more, more preferably about 3 times or more and 1000 times or less, further more preferably about 5 times or more and 800 times or less the concentration of aluminum inside the particle in mass ratio. When the difference in the concentration of aluminum is within the above range, excellent flame retardancy and fluidity (moldability) and excellent mechanical properties after molding can be highly achieved simultaneously.

The concentration of calcium and the concentration of aluminum in the oxide layer are determined as the concentration of calcium atoms and the concentration of aluminum atoms measured by any of the above-mentioned analysis methods, respectively.

By providing the oxide layer, not only the effect of simultaneously achieving flame retardancy of the powder, suppression of bridging during molding, mechanical properties, and fluidity, but also an effect of an oxygen shielding property by an oxide (magnesium oxide, aluminum oxide, calcium oxide, or the like) is imparted. As a result, pure magnesium is less likely to be oxidized inside the particle of the magnesium-based alloy powder. Therefore, an increase in the oxygen content in the particle as a whole can be suppressed, and a decrease in the mechanical properties of a molded body obtained finally can be suppressed.

In the above embodiment, a configuration in which oxides of magnesium, calcium, and aluminum are contained as the oxide layer is adopted, however, the invention is not limited thereto. An oxide of a component other than magnesium, calcium, and aluminum may be contained. Further, a configuration in which three oxides of magnesium, calcium, and aluminum are contained as the oxide layer is adopted, however, a configuration in which among the three oxides, at least calcium oxide or aluminum oxide is contained may be adopted.

The average thickness of the oxide layer is set to 30 nm or more and 100 nm or less, but is set to preferably 35 nm or more and 80 nm or less, more preferably 40 nm or more and 60 nm or less. By setting the average thickness of the oxide layer within the above range, bridging in a cylinder is suppressed, and the thixotropy is improved, and therefore, the fluidity in a die becomes favorable, and the mechanical property of a molded body can be improved.

When the average thickness of the oxide layer is less than the above lower limit, bridging may occur in a cylinder, and depending on the particle diameter of the magnesium-based alloy powder, the flame retardancy and fluidity of the raw material for thixomolding may be deteriorated. On the other hand, when the average thickness of the oxide layer exceeds the above upper limit, depending on the particle diameter of the magnesium-based alloy powder, the mechanical properties of a molded body to be produced may be deteriorated.

The average thickness of the oxide layer can be measured based on the gray levels in an observation image by an electron microscope or the distribution state of calcium, aluminum, and oxygen described above. The thickness is measured at arbitrary 10 or more sites of the oxide layer, and the average thereof is determined to be the average thickness t0 of the oxide layer. In the measurement of the thickness per site, the thickness within a length of 5 μm of the oxide layer is continuously measured, and the average thereof is determined to be the average thickness to (n is an integer of 1 to 10 (in the case where the number of measurement sites is 10)) of the oxide layer per site. Therefore, in the case where the number of measurement sites is 10, "t0=(t1+t2+. . . t10)/10".

The average dendrite secondary arm spacing (DAS) of crystal structures of the magnesium-based alloy powder is set to preferably 5 μm or less, more preferably 4 μm or less, further more preferably 3.5 μm or less. The DAS depends on the cooling rate during powder atomization, and this DAS is achieved by rapid cooling. In the magnesium-based alloy powder in this embodiment, by the presence of the oxide layer containing at least one of calcium and aluminum, bridging in a cylinder is suppressed, and the thixotropy is improved, whereby the fluidity in a die becomes favorable, and the mechanical properties of a molded body are improved. This oxide layer becomes thick in a portion where the crystal grain boundary appears on a powder surface. That is, by rapid cooling during atomization, the DAS is decreased, and by micronizing the structures in the powder, more crystal grain boundaries are made to appear on a powder surface, and the oxide layer can be controlled thick. When the average DAS of crystal structures is within the above range, a molded body having particularly excellent mechanical properties is obtained.

That is, when the average DAS of crystal structures exceeds the above upper limit, the frequency and length of the crystal grain boundary appearing on a powder surface are decreased, and bridging in a cylinder is induced, and also the thixotropy is deteriorated, and thus, a favorable molded body cannot be obtained.

The measurement of the DAS can be performed, for example, in accordance with the procedure described in "Measurement of Dendrite Arm Spacing" (The Japan Institute of Light Metals, Committee of Casting and Solidification), and in the calculation of the average, 100 or more particles selected randomly are used. The secondary arm spacings are determined with respect to dendrites observed in a central portion of the cross section of the particle, and the average thereof is determined to be the average DAS.

The raw material for thixomolding according to this embodiment may be a raw material in which another powder is added to the above-mentioned magnesium-based alloy powder.

As the another powder, for example, various types of metal powders, various types of ceramic powders, various types of glass powders, various types of carbon powders, etc. are exemplified.

Also in the case where another powder is added, the addition amount thereof in terms of volume fraction is preferably smaller than that of the magnesium-based alloy powder.

Method for Producing Raw Material for Thixomolding

Next, a method for producing a raw material for thixomolding according to this embodiment will be described.

The above-mentioned raw material for thixomolding (magnesium-based alloy powder) may be a raw material produced by any method. Examples of the production method include various powdering methods such as an atomization method (a water atomization method, a gas atomization method, a spinning water atomization method, etc.), a reducing method, a carbonyl method, and a pulverization method. Among these, it is preferably a raw material produced by an atomization method, and more preferably a raw material produced by a spinning water atomization method.

In the spinning water atomization method, a cooling liquid is jet-supplied along the inner circumferential surface of a cooling cylindrical body and swirled along the inner circumferential surface of the cooling cylindrical body, whereby a cooling liquid layer is formed on the inner circumferential surface. On the other hand, a starting material of a magnesium-based alloy is melted, and the obtained molten metal (melt) is allowed to freely fall, and a liquid or gas jet is sprayed thereto.

That is, the method for producing a raw material for thixomolding according to this embodiment includes a step of producing a magnesium-based alloy powder by a spinning water atomization method. According to such a method, the molten metal is scattered thereby and incorporated into the cooling liquid layer. As a result, the scattered and atomized molten metal is rapidly cooled and solidified, whereby a magnesium-based alloy powder is obtained. In the thus produced magnesium-based alloy powder, the shape of each particle can be made to further approximate to a perfect sphere even if the particle diameter is relatively large as compared with a powder produced by the other powdering methods.

On the surface of the particle, a relatively uniform oxide layer can be formed. As a result, a raw material for thixomolding having favorable thixotropy as described above can be efficiently produced. In addition, the starting material in a molten state can be rapidly cooled in a very short time, and therefore, the crystal structures are remarkably micronized. As a result, a powder capable of producing a molded body having excellent mechanical properties is obtained.

FIG. 1 is a longitudinal cross-sectional view showing an exemplary device for producing a magnesium-based alloy powder by a spinning water atomization method.

A powder production device 100 shown in FIG. 1 includes a cooling cylindrical body 1 for forming a cooling liquid layer 9 on an inner circumferential surface, a pot 15 which is a supply container for supplying and allowing a molten metal 25 to flow down to a space portion 23 on the inner side of the cooling liquid layer 9, a pump 7 which is a unit for supplying the cooling liquid to the cooling cylindrical body 1, and a jet nozzle 24 which jets a liquid jet 26 for breaking up the flowing down molten metal 25 in a thin stream into liquid droplets and also supplying the liquid droplets to the cooling liquid layer 9.

The cooling cylindrical body 1 has a cylindrical shape and is disposed so that the axis line of the cylindrical body is along the vertical direction or is tilted at an angle of 30° or less with respect to the vertical direction. FIG. 1 shows a state where the axis line of the cylindrical body is tilted with respect to the vertical direction. The upper end opening of the cooling cylindrical body 1 is closed by a lid 2, and in the lid 2, an opening section 3 for supplying the flowing down molten metal 25 to the space portion 23 of the cooling cylindrical body 1 is formed.

Further, in an upper portion of the cooling cylindrical body 1, a cooling liquid jet tube 4 configured to be able to jet-supply the cooling liquid in the tangential direction of the inner circumferential surface of the cooling cylindrical body 1 is provided. Then, a plurality of ejection ports 5 of the cooling liquid jet tubes 4 are provided at equal intervals along the circumferential direction of the cooling cylindrical body 1. Further, the tube axis direction of the cooling liquid jet tube 4 is set so that it is tilted downward at an angle of about 0° or more and 20° or less with respect to a plane orthogonal to the axis line of the cooling cylindrical body 1.

The cooling liquid jet tube 4 is connected to a tank 8 via the pump 7 through a pipe, and the cooling liquid in the tank 8 sucked up by the pump 7 is jet-supplied into the cooling cylindrical body 1 through the cooling liquid jet tube 4. By doing this, the cooling liquid gradually flows down while spinning along the inner circumferential surface of the cooling cylindrical body 1, and accompanying this, a layer of the cooling liquid (cooling liquid layer 9) along the inner circumferential surface is formed. A cooler may be interposed as needed in the tank 8 or in the middle of the circulation flow channel. As the cooling liquid, other than water, an oil (a silicone oil or the like) is used, and further, any of a variety of additives may be added thereto. Further, by removing dissolved oxygen in the cooling liquid in advance, oxidation accompanying cooling of the powder to be produced can be suppressed.

Further, in a lower portion of the inner circumferential surface of the cooling cylindrical body 1, a layer thickness adjustment ring 10 for adjusting the layer thickness of the cooling liquid layer 9 is detachably provided. By providing this layer thickness adjustment ring 10, the flow-down speed of the cooling liquid is controlled, and therefore, the layer thickness of the cooling liquid layer 9 is ensured, and also the uniformity of the layer thickness can be achieved.

Further, in a lower portion of the cooling cylindrical body 1, a liquid draining net body 11 having a cylindrical shape is continuously provided, and on the lower side of this liquid draining net body 11, a powder recovery container 12 having a funnel shape is provided. Around the liquid draining net body 11, a cooling liquid recovery cover 13 is provided so as to cover the liquid draining net body 11, and a drain port 14 formed in a bottom portion of this cooling liquid recovery cover 13 is connected to the tank 8 through a pipe.

In the space portion 23, the jet nozzle 24 for jetting air, an inert gas, or the like is provided. This jet nozzle 24 is attached to the tip end of a gas supply tube 27 inserted through the opening section 3 of the lid 2 and is disposed such that the jet port thereof is oriented to the molten metal 25 in a thin stream and the cooling liquid layer 9.

When a magnesium-based alloy powder is produced by such a powder production device 100, first, the pump 7 is operated and the cooling liquid layer 9 is formed on the inner circumferential surface of the cooling cylindrical body 1, and then, the molten metal 25 in the pot 15 is allowed to flow down in the space portion 23. When the liquid jet 26 is blown to this molten metal 25, the molten metal 25 is scattered, and the atomized molten metal 25 is incorporated in the cooling liquid layer 9. As a result, the atomized molten metal 25 is cooled and solidified, whereby a magnesium-based alloy powder is obtained.

In the spinning water atomization method, by continuously supplying the cooling liquid, the cooling liquid layer 9 in a given condition can be stably maintained, and therefore, the particle diameter, the aspect ratio, the crystal structures, etc. of the magnesium-based alloy powder to be produced are also stabilized. As a result, the above-mentioned magnesium-based alloy powder can be particularly efficiently produced.

The particle diameter, the circularity, the aspect ratio, the apparent density, the thickness of the oxide layer, the average DAS, etc. of the magnesium-based alloy powder are controlled by adjusting the production conditions, respectively. For example, by increasing the flow rate or flow amount of the cooling liquid, even if the particle diameter is larger, the thickness of the oxide layer can be made thinner, or the average DAS can be made smaller. Further, by reducing the flow-down amount of the molten metal 25 or by increasing the flow rate of the liquid jet 26, the particle diameter of the magnesium-based alloy powder can be made smaller, or the thickness of the oxide layer can be made thinner. In addition, the circularity, the aspect ratio, and the apparent density can also be adjusted by the flow rate or the flow amount of the cooling liquid.

Here, it is preferred that the pressure when jetting the cooling liquid to be supplied to the cooling cylindrical body 1 is set to about 50 MPa or more and 200 MPa or less, and the liquid temperature is set to about −10° C. or higher and 40° C. or lower. According to this, the flow rate of the cooling liquid layer 9 is optimized, and the atomized molten metal 25 can be cooled appropriately and uniformly.

When the starting material of the magnesium-based alloy is melted, the melting temperature is preferably set to about Tm+20° C. or higher and Tm+200° C. or lower, more preferably set to about Tm+50° C. or higher and Tm+150° C. or lower with respect to the melting point Tm of the magnesium-based alloy. According to this, when the molten metal 25 is atomized by the liquid jet 26, particles in which the variation in the properties among particles can be suppressed to particularly small, and also the particle diameter, the aspect ratio, the apparent density, the thickness of the oxide layer, etc. are within the above-mentioned ranges are obtained.

The jet nozzle 24 may be provided as needed and may be omitted. In this case, the cooling cylindrical body 1 is disposed so that the axis line is tilted with respect to the vertical direction, and the molten metal 25 in a thin stream is allowed to flow down directly on the cooling liquid layer 9. According to this, the molten metal 25 is atomized and also cooled and solidified by the flow of the cooling liquid layer 9, and thus, a magnesium-based alloy powder having a relatively large particle diameter is obtained.

Magnesium-Based Alloy Molded Body

A molded body according to this embodiment is produced by molding the raw material for thixomolding according to this embodiment using a thixomolding method. That is, the molded body according to this embodiment includes the raw material for thixomolding according to this embodiment. Such a molded body has a high strength and few molding defects due to favorable thixotropy based on the raw material for thixomolding.

The thixomolding method is a method for obtaining a molded body having a desired shape by injection molding a raw material in a semi-molten state. In such a method, the melting temperature can be lowered as compared with a die casting method or the like, and therefore, uniformity and high precision of the structures of the molded body are easily achieved. Accordingly, a molded body having a high mechanical strength and high dimensional accuracy is obtained.

Figure 2:
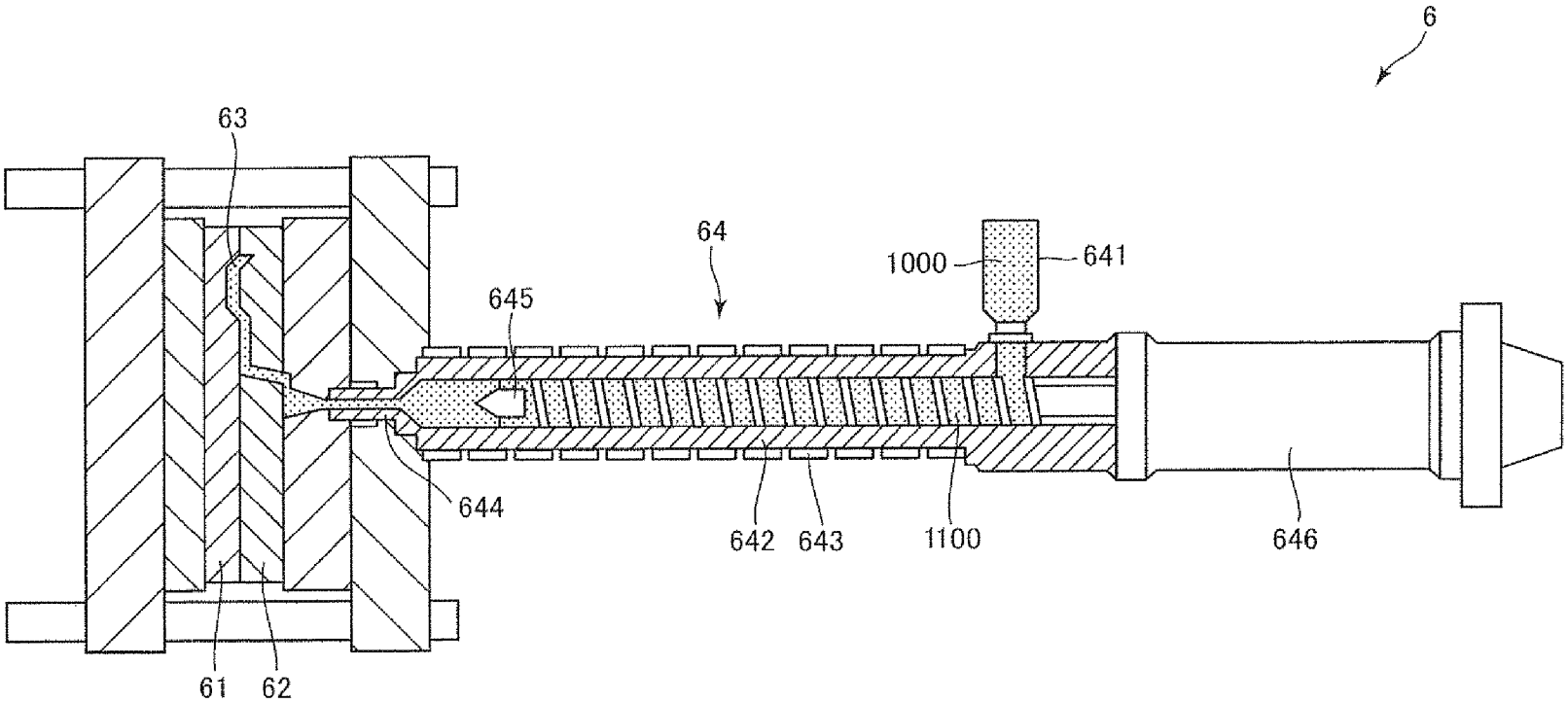
FIG. 2 is a partial cross-sectional view showing an exemplary injection molding machine to be used in a thixomolding method.

FIG. 2 is a partial cross-sectional view showing an exemplary injection molding machine to be used in a thixomolding method.

An injection molding machine 6 shown in FIG. 2 includes a pair of dies 61 and 62 provided so as to be mutually openable and closable, a cavity 63 formed in the pair of dies 61 and 62, and an injection machine 64 which injects a semi-molten slurry 1100 to the cavity 63.

The injection machine 64 includes a hopper 641 for feeding a raw material for thixomolding 1000, a heating cylinder 642 which is supplied with the raw material for thixomolding 1000 fed into the hopper 641, a heater 643 which is wound around the outer periphery of the heating cylinder 642, and a nozzle 644 which connects the tip end of the heating cylinder 642 to the cavity 63.

Further, the injection machine 64 includes a screw 645 which transports the semi-molten slurry 1100 formed in the heating cylinder 642 to the nozzle 644, and a driving unit 646 which drives the screw 645.

The raw material for thixomolding 1000 fed into the hopper 641 is supplied into the heating cylinder 642. Then, the raw material for thixomolding 1000 is converted into a semi-molten state by being heated with the heater 643, whereby the semi-molten slurry 1100 is obtained.

This semi-molten slurry 1100 is transported to the nozzle 644 by the screw 645, and then injected to the cavity 63. The injected semi-molten slurry 1100 is filled in the cavity 63, and cooled and solidified. Thereafter, the resulting material is released from the cavity, whereby a molded body having the shape of the cavity 63 is obtained.

The temperature of the semi-molten slurry 1100 is appropriately set according to the composition of the raw material for thixomolding 1000, the shape of the cavity 63, etc., but is set to, for example, preferably 400° C. or higher and 700° C. or lower, more preferably 500° C. or higher and 650° C. or lower, further more preferably 550° C. or higher and 630° C. or lower. Such a temperature is a low temperature as compared with the related art, and therefore, a thermal effect is suppressed, and the dimensional accuracy can be enhanced while suppressing the surface roughness of the molded body.

Such a molded body may be used for any purpose, and is used for, for example, components for transport devices such as components for automobiles, components for railroad cars, components for ships, and components for airplanes, and other than these, components for electronic devices such as components for personal computers, components for cellular phone terminals, components for smartphones, components for tablet terminals, components for wearable devices, and components for cameras, and a variety of structures such as ornaments, artificial bones, and artificial dental roots.

Hereinabove, the raw material for thixomolding, the method for producing a raw material for thixomolding, and the molded body according to the invention have been described with reference to preferred embodiments, however, the invention is not limited thereto.

For example, another coating film may be further provided on the surface of the particle of the magnesium-based alloy powder according to the above-mentioned embodiment.

In addition, the method for producing a raw material for thixomolding may be a method in which an arbitrary step is added to the above-mentioned embodiment.

Examples

Next, specific examples of the invention will be described.

1. Production of Molded Body

Sample No. 1

[1] First, the starting material was melted in a high-frequency induction furnace, and also powdered by a spinning water atomization method, whereby a raw material for thixomolding composed of a magnesium-based alloy powder was obtained. The alloy composition of the obtained magnesium-based alloy powder is shown in Table 1.

The setting conditions of a spinning water atomization device (powder production device) are shown below.

Cooling liquid jet pressure: 100 MPa

Cooling liquid temperature: 30° C.

Molten metal temperature: melting point of starting material+20° C.

[2] Subsequently, by a thixomolding method using an injection molding machine, the raw material for thixomolding was molded, whereby a molded body was obtained. The molding conditions at this time are as follows.

Molding conditions

Raw material melting temperature: 600° C.

Die temperature: 220° C.

Figure 3:
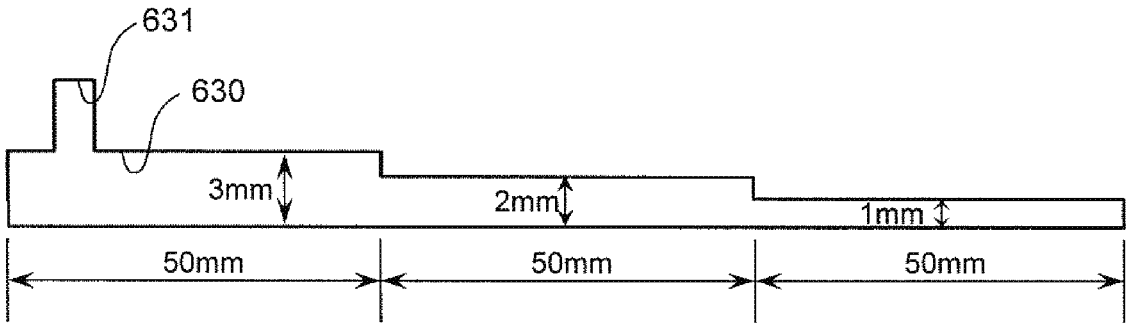
FIG. 3 is a cross-sectional view of a cavity of a die used for molding a raw material for thixomolding of Sample No. 1.

The cross-sectional view of a cavity of a die used for molding the raw material for thixomolding of Sample No. 1 is shown in FIG. 3. A cavity 630 shown in FIG. 3 has a flat columnar shape with a width of 50 mm (a length in the thickness direction of the sheet of FIG. 3 of 50 mm), a length of 150 mm, and a height of 1 to 3 mm. The height of the cavity 630 is set so that the height decreases stepwise toward the right in FIG. 3. To the left end of the cavity 630, a gate 631 is connected. The semi-molten slurry is to be injected into the cavity 630 through this gate 631.

In such a cavity 630, by measuring the length that the semi-molten slurry has reached, the fluidity of the semi-molten slurry can be quantitatively evaluated.

The conditions such as alloy composition, shape, particle diameter, average aspect ratio, and average DAS of the magnesium-based alloy powder are shown in Table 2.

Further, the presence or absence of clogging with the raw material during thixomolding is also shown in Table 2.

Samples Nos. 2 to 13

Molded bodies were obtained in the same manner as in Sample No. 1 except that the conditions for the raw material for thixomolding (magnesium-based alloy powder) were changed as shown in Table 2.

The alloy compositions of the used magnesium-based alloy powders are as shown in Table 1.

Further, in Tables 1 and 2 below, among the raw materials for thixomolding of the respective Sample Nos., those corresponding to the invention are denoted by "Ex." (Example), and those not corresponding to the invention are denoted by "Comp. Ex." (Comparative Example).

TABLE 1

| | | Magnesium-based alloy composition | | | | | | | | |
|---|---|---|---|---|---|---|---|---|---|---|
| | | Al | Zn | Mn | Fe | Si | Cu | Ni | Ca | Mg |
| | | mass % | | | | | | | | |
| Alloy composition 1 | Comparative Example | 9.0 | 0.67 | 0.10 | 0.002 | 0.025 | 0.005 | 0.002 | — | Bal. |
| Alloy composition 2 | Example | 9.5 | 0.65 | 0.12 | 0.002 | 0.024 | 0.004 | 0.001 | 0.25 | Bal. |
| Alloy composition 3 | Example | 8.5 | 0.68 | 0.09 | 0.002 | 0.026 | 0.006 | 0.002 | 0.75 | Bal. |
| Alloy composition 4 | Example | 7.8 | 0.72 | 0.08 | 0.002 | 0.023 | 0.004 | 0.002 | 1.8 | Bal. |
| Alloy composition 5 | Example | 7.0 | 0.78 | 0.06 | 0.002 | 0.022 | 0.003 | 0.002 | 4.7 | Bal. |
| Alloy composition 6 | Comparative Example | 1.9 | 0.77 | 0.07 | 0.03 | 0.021 | 0.003 | 0.003 | 1.9 | Bal. |

2. Evaluation of Raw Material for Thixomolding 2.1. Measurement of Average DAS

The cross section of the magnesium-based alloy powder of each Sample No. was observed with an electron microscope.

Subsequently, the average DAS was measured from the obtained observation image. The measurement results are shown in Table 2.

2.2. Measurement of Thickness of Oxide Layer

The cross section of the magnesium-based alloy powder of each Sample No. was observed with an electron microscope.

Subsequently, the thickness of the oxide layer was measured from the obtained observation image. The measurement results are shown in Table 2.

3. Evaluation of Molded Body 3.1. Measurement of Length (Fluidity Length) of Molded Body With respect to the molded body of each Sample No., the length thereof was measured. The measurement results are shown in Table 2.

3.2. Measurement of Proof Stress

With respect to the molded body of each Sample No., the 0.2% proof stress thereof was measured. The measurement results are shown in Table 2.

TABLE 2

| | | Production conditions and properties of raw material for thixomolding | | | | | | Evaluation results of molded body | | |
|---|---|---|---|---|---|---|---|---|---|---|
| | | Alloy composition — | Particle shape — | Thickness of coating layer mm | Average particle diameter mm | Average aspect ratio — | Average DAS μm | Clogging in cylinder — | Length of molded body mm | Proof stress MPa |
| Sample No. 1 | Comparative Example | Alloy composition 1 | chip (irregular shape) | <1 | 4 | 0.2 | 10 or more | absence | 78 | 170 |
| Sample No. 2 | Comparative Example | Alloy composition 2 | chip (irregular shape) | <1 | 4 | 0.3 | 10 or more | absence | 65 | 160 |
| Sample No. 3 | Comparative Example | Alloy composition 1 | sphere | 3 | 2 | 0.7 | 3 | presence | — | — |
| Sample No. 4 | Comparative Example | Alloy composition 1 | sphere | 6 | 2 | 0.6 | 8 | presence | — | — |
| Sample No. 5 | Comparative Example | Alloy composition 2 | sphere | 24 | 0.5 | 0.5 | 2 | presence | — | — |
| Sample No. 6 | Example | Alloy composition 2 | sphere | 44 | 0.75 | 0.6 | 2 | absence | 130 | 215 |
| Sample No. 7 | Example | Alloy composition 2 | sphere | 41 | 2 | 0.7 | 4 | absence | 120 | 205 |
| Sample No. 8 | Example | Alloy composition 3 | sphere | 56 | 2 | 0.7 | 4 | absence | 125 | 215 |
| Sample No. 9 | Comparative Example | Alloy composition 2 | sphere | 107 | 2 | 0.6 | 8 | absence | 95 | 155 |
| Sample No. 10 | Example | Alloy composition 4 | sphere | 88 | 3 | 0.6 | 5 | absence | 100 | 185 |
| Sample No. 11 | Comparative Example | Alloy composition 4 | sphere | 73 | 0.35 | 0.6 | 6 | presence | — | — |
| Sample No. 12 | Example | Alloy composition 5 | sphere | 93 | 0.5 | 0.5 | 5 | absence | 95 | 180 |
| Sample No. 13 | Comparative Example | Alloy composition 6 | sphere | 19 | 1.5 | 0.5 | 4 | presence | — | — |

As apparent from Table 2, it was confirmed that in the case of the molded bodies of the respective Examples, the length thereof is sufficiently long, and also the proof stress is sufficiently high. Accordingly, it was confirmed that the raw materials for thixomolding of the respective Examples have high fluidity (favorable thixotropy) and are capable of forming a molded body having a high strength.

The entire disclosure of Japanese Patent Application No. 2017-167945, filed Aug. 31, 2017 is expressly incorporated by reference herein.

What is claimed is:

1. A raw material for thixomolding, comprising:

a magnesium-based alloy powder which contains calcium in an amount of 0.2 mass % or more and 5 mass % or less and aluminum in an amount of 2.5 mass % or more and 12 mass % or less, wherein the magnesium-based alloy powder is produced by an atomization method, an average particle diameter of the magnesium-based alloy powder is 2.0 mm or more and 5.0 mm or less, an average aspect ratio of the magnesium-based powder that is an average of aspect ratios calculated by ((a minor axis)/(a major axis)) is 0.5 or more and 1 or less, and the magnesium-based alloy powder includes an oxide layer which has an average thickness of 30 nm or more and 100 nm or less and contains at least one of calcium and aluminum as an outermost layer.

2. The raw material for thixomolding according to claim 1, wherein an average dendrite secondary arm spacing of crystal structures of the magnesium-based alloy powder is 5 μm or less.

3. A molded body, comprising the raw material for thixomolding according to claim 2.

4. The raw material for thixomolding according to claim 1, wherein a minimum particle diameter of the magnesium-based alloy powder is 0.5 mm or more.

5. A molded body, comprising the raw material for thixomolding according to claim 4.

6. A molded body, comprising the raw material for thixomolding according to claim 1.

7. The raw material for thixomolding according to claim 1, wherein an average circularity of the magnesium-based alloy powder is 0.5 or more and 1 or less.

8. A molded body, comprising the raw material for thixomolding according to claim 7.

9. The raw material for thixomolding according to claim 1, wherein when the oxide layer contains the calcium, a concentration of the calcium in the oxide layer is 2 times or more, and when the oxide layer contains the aluminum, a concentration of the aluminum in the oxide layer is 2 times or more.

10. A molded body, comprising the raw material for thixomolding according to claim 9.

11. A raw material for thixomolding, comprising:

a magnesium-based alloy powder which contains calcium in an amount of 0.2 mass % or more and 5 mass % or less and aluminum in an amount of 2.5 mass % or more and 12 mass % or less, wherein the calcium and aluminum are segregated at a crystal grain boundary;

an average particle diameter of the magnesium-based alloy powder is 2.0 mm or more and 5.0 mm or less:

an average aspect ratio of the magnesium-based alloy powder that is an average of aspect ratios calculated by ((a minor axis)/(a major axis)) is 0.5 or more and 1 or less; and the magnesium-based alloy powder includes an oxide layer which has an average thickness of 30 nm or more and 100 nm or less and contains a mixture of oxides of magnesium, calcium, and aluminum as an outermost layer; and at locations of a surface of the powder where the crystal grain boundary appears, the thickness of the oxide layer is greater than at locations of the surface of the powder where the crystal grain boundary does not appear.

* * * * *